US005279080A

United States Patent [19]

Müller et al.

[11] Patent Number: 5,279,080

[45] Date of Patent: Jan. 18, 1994

[54] HAIR REMOVAL DEVICE

[75] Inventors: Christoph Müller, Bern; Iwan Hauck, bei Oester Konizstr. 302, 3098 Koniz, both of Switzerland

[73] Assignees: Swingbox System Christoph Müller, Bern; Iwan Hauck, Koniz, both of Switzerland

[21] Appl. No.: 58,042

[22] Filed: May 7, 1993

Related U.S. Application Data

[63] Continuation of Ser. No. 866,490, Apr. 10, 1992, abandoned.

[51] Int. Cl.[5] ..... B24D 15/02; B24B 55/02

[52] U.S. Cl. ..... 51/393; 51/392; 51/266; 51/356

[58] Field of Search ..... 51/391, 392, 393, 266, 51/267, 170 R; 356, 358

[56] References Cited

U.S. PATENT DOCUMENTS

| | | | |
|---|---|---|---|
| 1,347,091 | 7/1920 | Hamlin | 51/392 |
| 1,710,308 | 1/1926 | Grifalconi | 51/392 |
| 1,910,647 | 9/1932 | Steeg et al. | 51/391 |
| 1,965,861 | 4/1933 | Schneider | 606/31 |
| 2,010,332 | 5/1933 | Steeg et al. | 51/400 |
| 2,040,599 | 12/1929 | Davis | 51/391 |
| 2,046,240 | 7/1932 | Bayley | 51/407 |
| 2,311,060 | 8/1940 | Lurrain | 51/399 |
| 2,314,220 | 3/1943 | Johnson | 51/391 |
| 2,328,886 | 9/1943 | Andrews | 51/392 |
| 2,489,005 | 11/1949 | Bourdunis | 51/392 |
| 2,714,788 | 4/1954 | DiGiovanna | 51/170 R |
| 2,797,536 | 7/1957 | Shesler | 51/393 |
| 4,320,601 | 3/1982 | Haney | 51/391 |
| 4,484,419 | 11/1984 | Freerks | 51/391 |
| 4,922,665 | 5/1990 | Wanatowicz | 51/392 |
| 4,930,267 | 6/1990 | Hill et al. | 51/393 |
| 4,964,065 | 3/1900 | Bligh | 51/392 |
| 5,084,046 | 1/1992 | Isack | 606/43 |

*Primary Examiner*—Bruce M. Kisliuk
*Assistant Examiner*—Bo Bounkong
*Attorney, Agent, or Firm*—Jacobson, Price, Holman & Stern

[57] ABSTRACT

A device for removing hair from the human body is in the form of an abrasive disc and an ergonomically designed handle for applying the disc to the skin with a rotary, orbital or sweeping motion to remove hair by abrasion. The top of the disc retains a supply of liquid which is supplied to the abrasive skin interface through an aperture in the disc. The undersurface of the disc is uniquely contoured to facilitate use on awkwardly shaped areas of the body such as around elbows and ankles.

9 Claims, 2 Drawing Sheets

FIG. 4
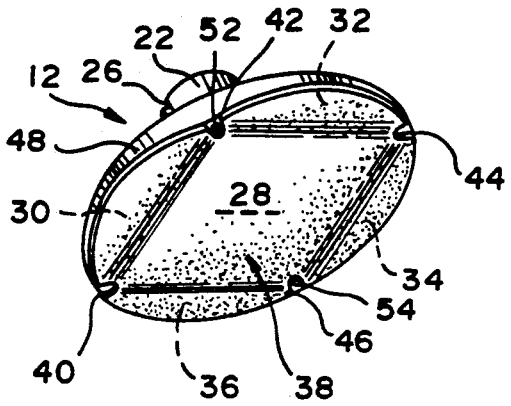
FIG. 5
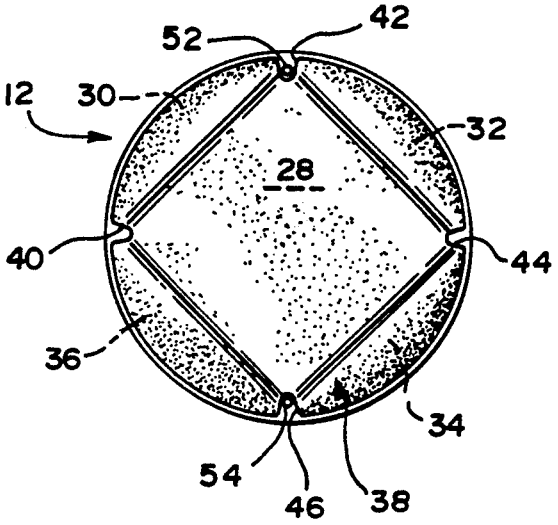
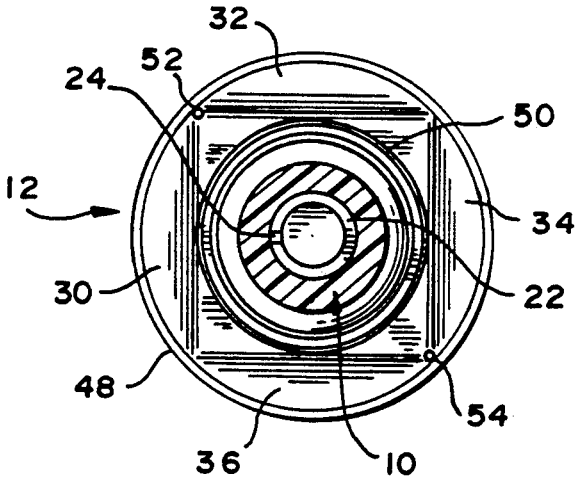
FIG. 6

HAIR REMOVAL DEVICE

This is a continuation of application Ser. No. 07/866,490, filed Apr. 10, 1992 abandoned.

BACKGROUND OF THE INVENTION

This invention relates to a hair removal device (depilator) for removing hair from the human body, with particular reference to the arms and legs.

The prior art is replete with hair removal devices and systems, but none of these have been found to be totally satisfactory.

For example, cutting or shaving systems which employ blade shavers, electric razors or the like are readily available and remove hair quickly. However, hair is not removed entirely, the roots remain intact and continue to grow, so that shaving has to be repeated at relatively short intervals. Moreover, repeated shaving can produce strengthened stubble which may be considered unattractive. Electric shavers require a power source while blade razors can produce skin irritation or cuts.

Plucking systems using electrical plucking devices, waxes or resins are also available. With these systems, the hair is completely removed, but the process is painstaking and can be painful.

Hair dissolving systems are also known, but these generally require relatively expensive chemical agents.

Finally, hair abrading systems have been proposed and the present invention relates to improvements in this field.

SUMMARY OF THE INVENTION

It is an object of the invention to provide a simple, economic, easy to use, hand-operated hair removal device operating on an abrasion principle whereby hair is rolled and twisted out of the respective hair channels.

Broadly stated, the device comprises an elongate ergonomically designed handle, and an abrasive disc, preferably detachable, on the bottom of the handle, both the handle and the disc conveniently being rigid plastic moldings. The base surface of the disc which conveniently is circular, is covered by abrasive, preferably an adherent abrasive sheet, and according to one important aspect of the invention, the base surface has a unique contour. More particularly, the base surface of the disc has a central area which may be substantially flat and peripheral segments surrounding the central area, which are inclined upwardly towards the handle and preferably are somewhat curved. The upwardly inclined outer segments of the base surface allow the disc, when in use, more readily to accommodate itself to awkwardly shaped areas of the anatomy, for example areas around the ankles and elbows.

The abrasive sheet which is adhered to the base surface of the disc conveniently has small notches or cutouts at points corresponding to the junction points of the respective outer segments of the base surface of the disc. These enable the abrasive sheet to be applied smoothly over the base surface of the disc substantially without creases or wrinkles.

Operation of the disc for hair removal is by a gentle circular, orbital or sweeping action of the abrasive disc against the skin while gripping the handle (the handle and disc are non-rotatably attached together for this purpose) and the abrasive is preferably moistened, conveniently with water, for this operation.

According to another important aspect of the invention the disc is designed to retain a quantity of moisture and supply same, in use, to the abrasive/skin interface. To this end, the upper surface of the disc is provided with an upstanding rim so that a liquid reservoir is formed between the rim and the handle. At least one small perforation is formed through the disc and the abrasive sheet for delivering liquid from the reservoir to the abrasive/skin interface. Conveniently, the perforation in the disc may align with one of the aforementioned notches or cutouts in the abrasive sheet, so that the notch or cutout itself forms the perforation in the abrasive sheet.

Operation of the device is simple and relatively painless. With repeated usages, hair becomes thinner and finer and removal intervals become longer. Additional features and advantages of the invention will be apparent from the ensuing description and claims read in conjunction with the attached drawings.

BRIEF DESCRIPTION OF DRAWINGS

FIG. 4 is a perspective underneath view of the disc, FIG. 5 is an underneath plan view of the disc, and FIG. 6 is a sectional view on line 6—6 of FIG. 2.

DESCRIPTION OF PREFERRED EMBODIMENT

Figure 1:
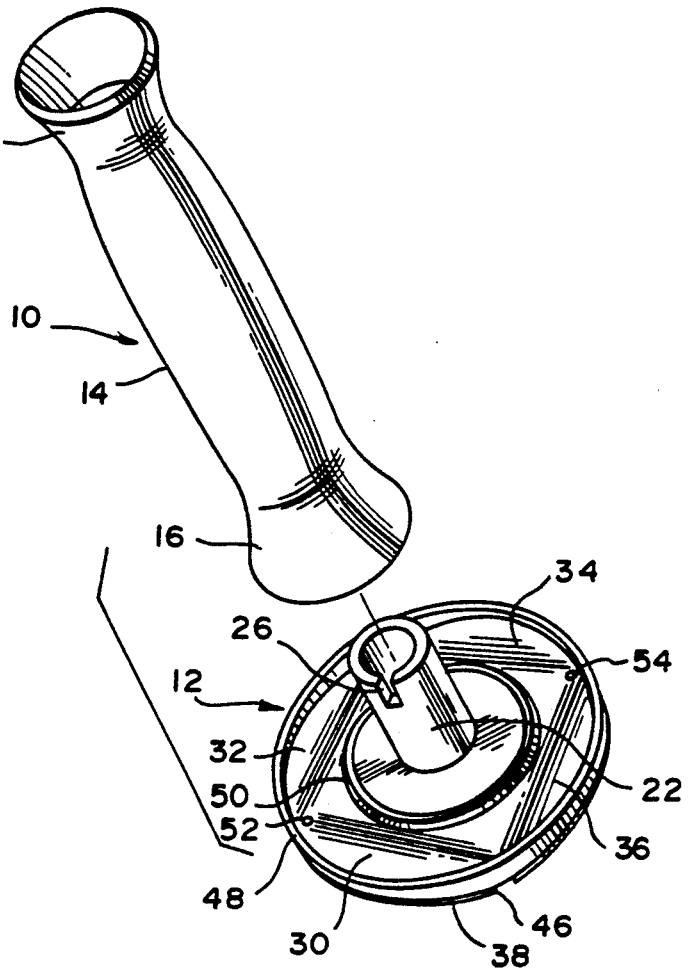
FIG. 1 is an exploded perspective view of a hair removal device according to the invention.
Figure 2:
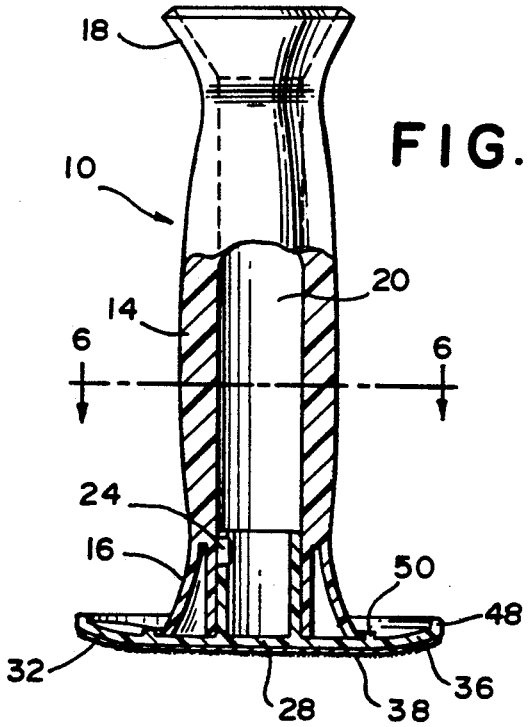
FIG. 2 is a vertical elevation, partly in section of a handle part of the device.
Figure 3:
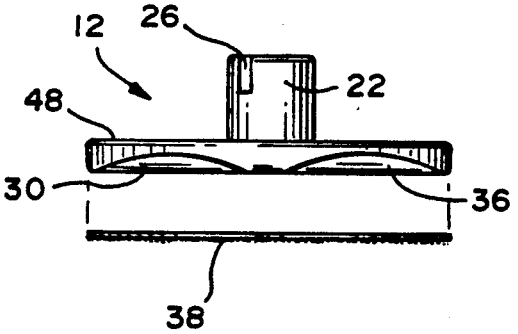
FIG. 3 is an exploded elevational view of an abrasive disc part of the device.

An exemplary hair removal device according to the invention is herewith illustrated and comprises a handle 10 and an abrasive disc 12 for releasable attachment to the bottom of the handle, as will be described, when the device is to be used. Both the handle and disc may conveniently be molded in a hard and rigid plastic, but other hard materials, e.g., wood, can also be used.

The handle 10 is ergonomically shaped and sized, for example to conveniently fit a female hand, with a ballooned central portion 14 and flared ends 16, 18. Internally, the handle has an elongate central bore 20 to receive, at the end 16, and upstanding cylindrical boss 22 on the top of the disc, with a sliding fit. The handle has an internal lug 24 to fit in a slot 26 at the top of boss 22, so as to fit a slot 26 at the top of boss 22, so as to non-rotatably connect the disc to the handle. It is not necessary for the boss 22 to be a tight fit in bore 20 because in use, the disc will be pressed lightly down against the skin while the handle (and hence the disc) are rotated.

The disc is circular (although other shapes can be used) with a substantially flat central portion 28 and four peripheral segment portions 30, 32, 34, 36 which are upwardly inclined and may have a slight curvature. The diameter of the disc is preferably about 62 MM.

On the undersurface of the disc, there is adhered a conforming sheet of abrasive paper 38 of a kind intended to used in a wet state. The paper may be a latex type sheet adhered to the undersurface of the disc by any suitable adhesive. The abrasive on sheet 38 may have a Norton grit size in a range of 500–1200, with 800 being the preferred grit size. Further, sheet 38 is provided with four small circumferential slits or notches 40, 42, 44, 46 aligned with the junctions of the respective disc segments 30–36. The notches allow sheet 38 to be smoothly adhered to the under surface of the disc without any wrinkling or creasing of the paper due to the uneven contour of the disc undersurface.

On its upper surface, the disc has a peripheral rim 48, and an inner rim 50, both of which stiffen the disc. Also, the outer rim allows the upper surface of the disc to be used as a reservoir for liquid to wet the abrasive. To this end the disc has apertures 52, 54 aligned with respective ones of the notches 40–46 to feed liquid, generally water, to the abrasive/skin interface.

In use, with liquid applied to the disc, it is manipulated over the skin with a circular, orbital or sweeping motion to remove hair, as previously described. The contours of the disc undersurface, facilitate use of the device in difficult areas and the reservoir which can be repeatedly replenished allows liquid to be supplied continuously to the abrasive/skin interface. Discs having distinguishable features, such as different colors, can be supplied in kit form with a single handle, for example for use by different family members.

While only a preferred embodiment of the invention has been described herein in detail, the invention is not limited thereby and modifications can be made within the scope of the attached claims.

We claim:

1. A hair removal device comprising a circular disc having an upper surface and a handle extending from the upper surface for applying the disc to a user's skin with a rotary, orbital, or sweeping motion, the disc further having an abrasive undersurface with a substantially flattened central portion in the form of a polygon and peripheral segments surrounding the central portion which segments extend from respective sides of the polygon and which are inclined upwardly towards the handle from the central portion to an outer periphery of the disc, wherein the abrasive undersurface includes a sheet of abrasive material adhered to the disc by adhesive over substantially the entire undersurface including said segments whereby the sheet of abrasive material extends substantially without obstruction over the entire undersurface of the disc including said segments.

2. A device as claimed in claim 1 wherein the segments each have a curved undersurface.

3. A device as claimed in claim 1 wherein said sheet has peripheral notches aligned with junctions between respective ones of said segments to provide smooth adherence of said sheet to the disc.

4. A device as claimed in claim 3, wherein at least one aperture is formed through the disc aligned with one of said notches and the disc has an upper surface defining a liquid reservoir whereby, in use, liquid in said reservoir is supplied through the said aperture to the abrasive undersurface of the disc.

5. A device as claimed in claim 1 wherein the abrasive undersurface comprises abrasive having a grit size between 500–1200 grit.

6. A device as claimed in claim 5 wherein the grit size is 800 grit.

7. A device as claimed in claim 1 including releasable attachment means between the handle and the disc.

8. A device as claimed in claim 1 wherein the handle has an elongate shape with a ballooned central portion and flared ends.

9. A hair removal device comprising a disc having an upper surface and a handle extending from the upper surface for applying the disc to a user's skin with a rotary, orbital, or sweeping motion, the disc further having an abrasive undersurface with a substantially flattened central portion and peripheral segments around the central portion which are inclined upwardly towards the handle from the central portion to an outer periphery of the disc, wherein the abrasive undersurface includes a sheet of abrasive material adhered to the disc by adhesive over substantially the entire undersurface including said segments whereby the sheet of abrasive material extends substantially without obstruction over the entire undersurface of the disc including said segments, wherein said sheet has peripheral notches aligned with junctions between respective ones of said segments to provide smooth adherence of said sheet to the disc, and wherein at least one aperture is formed through the disc aligned with one of said notches and the disc has an upper surface defining a liquid reservoir whereby, in use, liquid in said reservoir is supplied through said aperture to the abrasive undersurface of the disc.

* * * * *